US010989196B2

(12) United States Patent
Endou et al.

(10) Patent No.: US 10,989,196 B2
(45) Date of Patent: Apr. 27, 2021

(54) COMPRESSOR HAVING MUFFLER FUNCTION

(71) Applicant: DAIKIN INDUSTRIES, LTD., Osaka (JP)

(72) Inventors: Takeshi Endou, Osaka (JP); Yoshitomo Tsuka, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 22 days.

(21) Appl. No.: 16/317,219

(22) PCT Filed: Jul. 14, 2017

(86) PCT No.: PCT/JP2017/025761
§ 371 (c)(1),
(2) Date: Jan. 11, 2019

(87) PCT Pub. No.: WO2018/012623
PCT Pub. Date: Jan. 18, 2018

(65) Prior Publication Data

US 2019/0316589 A1 Oct. 17, 2019

(30) Foreign Application Priority Data

Jul. 14, 2016 (JP) ..... JP2016-139666

(51) Int. Cl.
*F01C 1/02* (2006.01)
*F03C 2/00* (2006.01)
(Continued)

(52) U.S. Cl.
CPC ..... *F04C 29/065* (2013.01); *F04B 39/0055* (2013.01); *F04B 39/123* (2013.01);
(Continued)

(58) Field of Classification Search
CPC .... F04C 18/0215; F04C 23/008; F04C 29/04; F04C 29/06; F04C 29/065; F04C 29/12;
(Continued)

(56) References Cited

U.S. PATENT DOCUMENTS 4,475,360 A * 10/1984 Suefuji ..... F04C 18/0215 418/55.5
6,053,715 A * 4/2000 Hirano ..... F04C 29/042 418/55.6
(Continued)

FOREIGN PATENT DOCUMENTS

EP 2 330 300 A1 6/2011
JP 4-60191 A 2/1992
(Continued)

OTHER PUBLICATIONS

International Preliminary Report of corresponding PCT Application No. PCT/JP2017/025761 dated Jan. 24, 2019.
(Continued)

*Primary Examiner* — Theresa Trieu
(74) *Attorney, Agent, or Firm* — Global IP Counselors, LLP

(57) ABSTRACT

A compressor includes a first throttle portion that receives a refrigerant at an intermediate pressure from an injection pipe of a refrigerant circuit, an enlarged flow path portion that receives the refrigerant from the first throttle portion, a second throttle portion that receives the refrigerant from the enlarged flow path portion, and a compression element. The compression element includes a compression chamber that receives the refrigerant from the second throttle portion. The first throttle portion has a flow path cross-sectional area that is narrower than both a flow path cross-sectional area of the injection pipe and a flow path cross-sectional area of the enlarged flow path portion. The second throttle portion has a flow path cross-sectional area that is narrower than the
(Continued)

flow path cross-sectional area of the enlarged flow path portion.

20 Claims, 13 Drawing Sheets

(51) Int. Cl.

| | |
|---|---|
| ***F03C 4/00*** | (2006.01) |
| ***F04C 2/00*** | (2006.01) |
| ***F04C 29/06*** | (2006.01) |
| ***F04C 18/02*** | (2006.01) |
| ***F04C 29/12*** | (2006.01) |
| ***F04B 39/12*** | (2006.01) |
| ***F04B 39/00*** | (2006.01) |

(52) U.S. Cl.
CPC ..... *F04C 18/0215* (2013.01); *F04C 29/12* (2013.01); *F04C 2210/22* (2013.01); *F04C 2270/135* (2013.01)

(58) Field of Classification Search
CPC ..... F04C 2210/22; F04C 2270/135; F04B 39/00; F04B 39/0055; F04B 39/0061; F04B 39/06; F04B 39/12; F04B 39/123
USPC ..... 418/55.1–55.6, 57, 270; 417/310, 440
See application file for complete search history.

(56) References Cited

U.S. PATENT DOCUMENTS

| | | | | |
|---|---|---|---|---|
| 6,254,365 | B1 * | 7/2001 | Nakanishi | F04C 21/007 417/572 |
| 2011/0070115 | A1 * | 3/2011 | Takahashi | F04C 23/008 418/23 |
| 2015/0275895 | A1 * | 10/2015 | Tanaka | F04C 23/008 418/11 |

FOREIGN PATENT DOCUMENTS

| | | | |
|---|---|---|---|
| JP | 5-157046 | A | 6/1993 |
| JP | 10-37879 | A | 2/1998 |
| JP | 2017/025761 | A | 9/2017 |

OTHER PUBLICATIONS

International Search Report of corresponding PCT Application No. PCT/JP2017/025761 dated Sep. 26, 2017.
European Search Report of corresponding EP Application No. 17 82 7746.3 dated Mar. 27, 2019.

* cited by examiner

COMPRESSOR HAVING MUFFLER FUNCTION

CROSS-REFERENCE TO RELATED APPLICATIONS

This U.S. National stage application claims priority under 35 U.S.C. § 119(a) to Japanese Patent Application No. 2016-139666, filed in Japan on Jul. 14, 2016, the entire contents of which are hereby incorporated herein by reference.

TECHNICAL FIELD

The present invention relates to a compressor.

BACKGROUND ART

A compressor is used in a refrigerant circuit such as an air conditioner. The compressor sucks a low-pressure gas refrigerant into its compression chamber and compresses the low-pressure gas refrigerant to produce a high-pressure gas refrigerant to discharge. Some compressors implement a technique called gas injection in order to improve the capacity of the refrigerant circuit. In the gas injection technique, a pipe called an injection pipe is connected to the compression chamber of the compressor. In a part of the refrigerant circuit, there exists an intermediate pressure gas refrigerant that indicates a pressure value between the low-pressure gas refrigerant and the high-pressure gas refrigerant. The injection pipe introduces the intermediate gas refrigerant into the compression chamber.

The injection pipe often vibrates under pressure pulsation of the gas refrigerant. For this reason, noise is generated or excessive stress may be applied to the injection pipe. In order to reduce problems caused by such vibrations and stress. Japanese Laid-Open Patent Application Publication No. 2010-185406 discloses an air conditioner in which a muffler is attached to the injection pipe.

SUMMARY

Due to the weight of the muffler, piping such as the injection pipe connecting the compressor and the muffler receives a large stress, which may cause a problem in terms of reliability of the equipment.

The present invention has been made to accomplish an objective of decreasing defects caused by vibrations and stress that a pipe receives in a compressor.

A compressor according to a first aspect of the present invention compresses a low-pressure refrigerant sucked therein to discharge a high-pressure refrigerant. The compressor includes a first throttle portion, an enlarged flow path portion, a second throttle portion, and a compression element. The first throttle portion receives a refrigerant at an intermediate pressure from an injection pipe of a refrigerant circuit. The enlarged flow path portion receives the refrigerant from the first throttle portion. The second throttle portion receives the refrigerant from the enlarged flow path portion. The compression element has a compression chamber that receives the refrigerant from the second throttle portion. The first throttle portion has a flow path cross-sectional area that is narrower than both a flow path cross-sectional area of the injection pipe and a flow path cross-sectional area of the enlarged flow path portion. The second throttle portion has a flow path cross-sectional area that is narrower than the flow path cross-sectional area of the enlarged flow path portion.

According to this configuration, the first throttle portion, the enlarged flow path portion, and the second throttle portion have different flow path cross-sectional areas. Therefore, the path composed of the first throttle portion, the enlarged flow path portion, and the second throttle portion functions as a muffler and reduces the vibrations of each portion caused by pressure pulsation of the refrigerant.

A compressor according to a second aspect of the present invention is the compressor according to the first aspect of the present invention further including a pressure vessel that accommodates the compression element. At least a part of the second throttle portion is provided in the pressure vessel.

According to this configuration, at least a part of the second throttle portion is provided in the pressure vessel. Since a part of the flow of the pulsating refrigerant passes through the pressure vessel, the noise outside the pressure vessel is reduced as a result.

A compressor according to a third aspect of the present invention is the compressor according to the second aspect of the present invention, wherein at least a part of the enlarged flow path portion is provided in the pressure vessel.

According to this configuration, at least a part of the enlarged flow path portion is provided in the pressure vessel. Therefore, a pressure fluctuation of the refrigerant flowing from the enlarged flow path portion to the second throttle portion occurs in the pressure vessel, whereby the noise outside the pressure vessel is reduced.

A compressor according to a fourth aspect of the present invention is the compressor according to any one of the first aspect to the third aspect of the present invention, wherein the enlarged flow path portion and the second throttle portion are configured as the same member.

According to this configuration, the enlarged flow path portion and the second throttle portion are the same member. Therefore, it is easy to assemble a path that functions as a muffler.

A compressor according to a fifth aspect of the present invention is the compressor according to any one of the first aspect to the third aspect of the present invention, wherein the first throttle portion, the enlarged flow path portion, and the second throttle portion are configured as separate members.

According to this configuration, the first throttle portion, the enlarged flow path portion, and the second throttle portion are configured as separate members. Therefore, a specification of the path functioning as the muffler can be easily modified by replacing the parts thereof.

A compressor according to a sixth aspect of the present invention is the compressor according to any one of the first aspect to the fifth aspect of the present invention, wherein the enlarged flow path portion is composed of a plurality of members.

According to this configuration, the enlarged flow path portion is composed of a plurality of members. Therefore, it is easy to adjust a length, a flow path cross-sectional area, a radius of curvature, and the like of the enlarged flow path portion by replacing the parts thereof.

A compressor according to a seventh aspect of the present invention is the compressor according to any one of the first aspect to the sixth aspect of the present invention, wherein the flow path cross-sectional area of the enlarged flow path portion is 1.5 times or more, preferably 4.0 times or more, larger than the flow path cross-sectional area of the first throttle portion.

According to this configuration, a ratio of the flow path cross-sectional area of the enlarged flow path portion to the first throttle portion is 1.5 times or more, preferably 4.0 times or more. Therefore, vibrations are effectively reduced.

A compressor according to an eighth aspect of the present invention is the compressor according to any one of the first aspect to the seventh aspect of the present invention, wherein the flow path cross-sectional area of the enlarged flow path portion is 1.5 times or more, preferably 4.0 times or more, larger than the flow path cross-sectional area of the second throttle portion.

According to this configuration, a ratio of the flow path cross-sectional area of the enlarged flow path portion to the second throttle portion is 1.5 times or more, preferably 4.0 times or more. Therefore, vibrations are more effectively reduced.

A compressor according to a ninth aspect of the present invention is the compressor according to any one of the first aspect to the eighth aspect of the present invention, wherein a length of the first throttle portion is not less than 20 mm and not more than 200 mm.

According to this configuration, the first throttle portion ensures a predetermined length. Therefore, vibrations are more effectively reduced.

A compressor according to a tenth aspect of the present invention is the compressor according to any one of the first aspect to the ninth aspect of the present invention, wherein a length of the enlarged flow path portion is not less than 50 mm and not more than 400 mm.

According to this configuration, the enlarged flow path portion ensures a predetermined length. Therefore, vibrations are more effectively reduced.

A compressor according to an eleventh aspect of the present invention is the compressor according to any one of the first aspect to the tenth aspect of the present invention, wherein the compression element includes a fixed scroll and a movable scroll defining the compression chamber. The refrigerant that has exited the second throttle portion enters the compression chamber via the fixed scroll.

According to this configuration, the refrigerant passes through the fixed scroll. Therefore, the refrigerant is stably supplied to the compression chamber defined by the fixed scroll.

A compressor according to a twelfth aspect of the present invention is the compressor according to any one of the first aspect to the tenth aspect, wherein the compression element includes a fixed scroll and a movable scroll that define a compression chamber, and a support member that directly or indirectly supports the fixed scroll. The refrigerant that has exited the second throttle portion enters the compression chamber via the support member.

According to this configuration, the refrigerant passes through the support member. Therefore, the refrigerant is stably supplied to the compression chamber defined by the fixed scroll via the support member.

A compressor according to a thirteenth aspect of the present invention is the compressor according to any one of the first aspect to the tenth aspect of the present invention, wherein the compression element includes a fixed scroll and a movable scroll defining a compression chamber, and a chamber forming member for defining a chamber together with the fixed scroll. The chamber functions as a flow path for the high-pressure refrigerant discharged from the compression chamber. The refrigerant that has exited the second throttle portion enters the compression chamber via the chamber forming member.

According to this configuration, the refrigerant passes through the chamber forming member. Therefore, the refrigerant is stably supplied to the compression chamber defined by the fixed scroll via the chamber forming member.

A compressor according to a fourteenth aspect of the present invention is the compressor according to any one of the first aspect to the thirteenth aspect of the present invention further including a third throttle portion that receives the refrigerant from the second throttle portion and guides the refrigerant to the compression chamber. The third throttle portion has a flow path cross-sectional area that is narrower than the flow path cross-sectional area of the second throttle portion.

According to this configuration, the compressor includes a third throttle portion. Therefore, when the refrigerant flows from the second throttle portion to the third throttle portion, the pulsation of the refrigerant can be further reduced.

A compressor according to a fifteenth aspect of the present invention is the compressor according to any one of the first aspect to the fourteenth aspect of the present invention, wherein the first throttle portion includes a valve that is electrically, magnetically, or pneumatically driven.

According to this configuration, the first throttle portion is a valve whose opening/closing and opening degree are controlled. Therefore, the arrangement of the controllable valve enables the first throttle portion to be easily configured.

According to the compressor of the present invention, the vibrations of each part caused by the pressure pulsation of the refrigerant are reduced.

DETAILED DESCRIPTION OF EMBODIMENTS

Hereinafter, compressors according to exemplary embodiments of the present invention will be described with reference to the drawings. It should be noted that a specific configuration of a compressor according to the present invention is not limited to the embodiments described hereinafter, can be appropriately changed without departing from the gist of the present invention.

First Exemplary Embodiment (1) Overall Configuration

Figure 1:
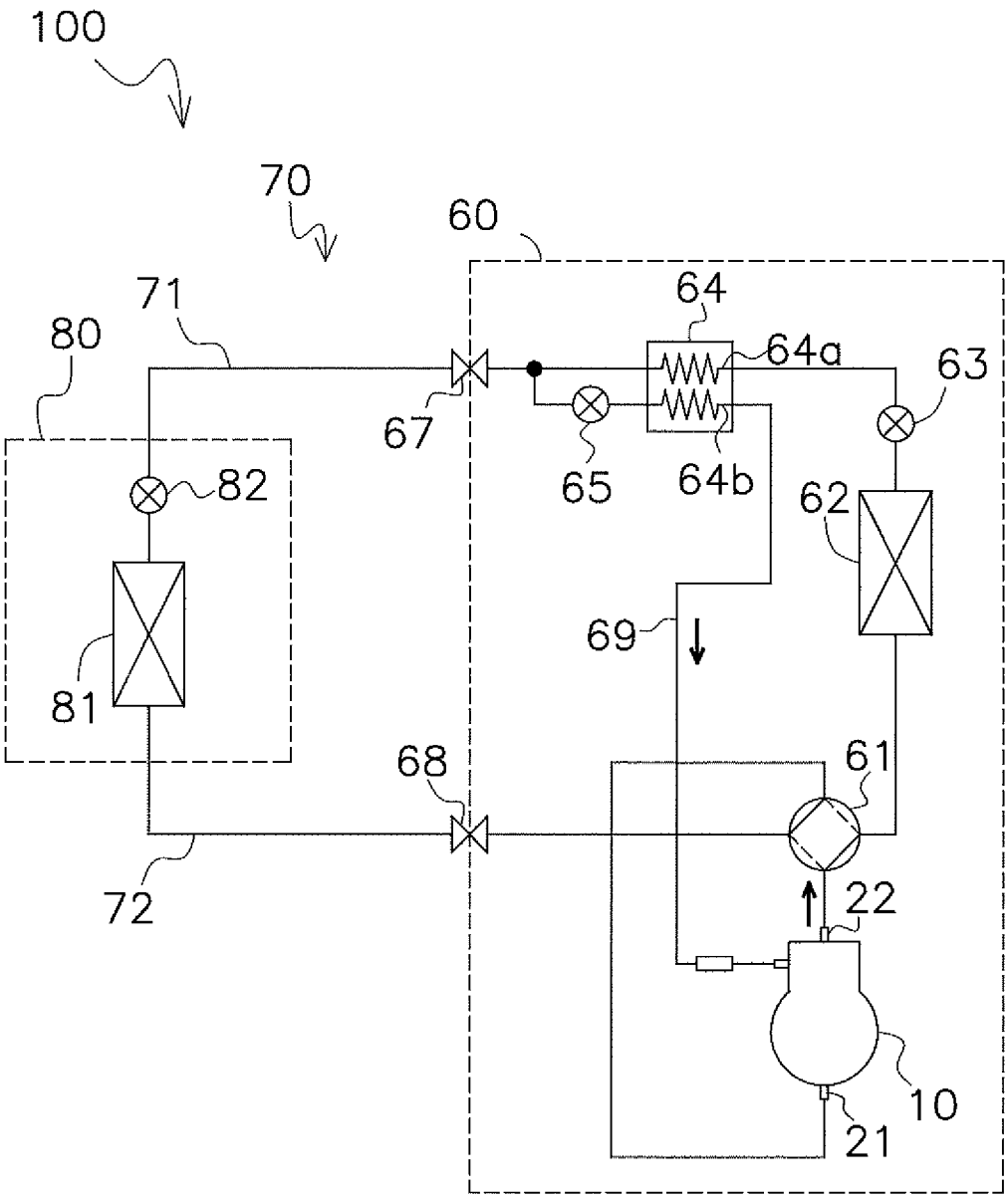
FIG. 1 is a schematic diagram illustrating a refrigerant circuit 100 of an air conditioner using a compressor 10 according to a first embodiment of the present invention.

FIG. 1 is a diagram of a refrigerant circuit 100 of an air conditioner in which a compressor 10 according to an exemplary embodiment of the present invention is used. The refrigerant circuit 100 includes an outdoor unit 60, an indoor unit 80, and a refrigerant piping 70.

(1-1) Outdoor Unit 60

The outdoor unit 60 functions as a heat source. The outdoor unit 60 includes a compressor 10, a four-way switching valve 61, an outdoor heat exchanger 62, an outdoor expansion valve 63, an economizer heat exchanger 64, an injection expansion valve 65, a liquid shutoff valve 67, and a gas shutoff valve 68.

The compressor 10 is a compressor for compressing a refrigerant that is a fluid. The compressor 10 compresses a gaseous low-pressure refrigerant sucked from a suction pipe 21 and discharges a gaseous high-pressure refrigerant from a discharge pipe 22. The four-way switching valve 61 forms a connection indicated by a solid line during a cooling operation and forms a connection indicated by a broken line during a heating operation. The outdoor heat exchanger 62 performs heat exchange between the refrigerant and the air using a fan (not shown), and functions as a condenser during the cooling operation and as an evaporator during the heating operation. The outdoor expansion valve 63 is a valve whose opening degree is adjustable, and functions as a decompressor of the refrigerant. The liquid shutoff valve 67 and the gas shutoff valve 68 are openable and closable valves that are to be closed during maintenance or the like of the air conditioner.

The economizer heat exchanger 64 supercools the liquid refrigerant discharged from the condenser of the refrigerant. The economizer heat exchanger 64 includes a main path 64*a* and an auxiliary path 64*b*. The main path 64*a* is a path through which the liquid refrigerant to be subjected to supercooling passes. The auxiliary path 64*b* is a path through which a gas refrigerant that acts as a cold heat source necessary for a supercooling operation passes. The gas refrigerant acting as this cold heat source is an intermediate pressure gas refrigerant produced by the injection expansion valve 65 decompressing the liquid refrigerant. The intermediate pressure gas refrigerant leaving the auxiliary path 64*b* is guided to the compressor 10 by an injection pipe 69.

(1-2) Indoor Unit 80

The indoor unit 80 adjusts the temperature of the air in the room where there is a user present. The indoor unit 80 includes an indoor heat exchanger 81 and an indoor expansion valve 82. The indoor heat exchanger 81 performs heat exchange between the refrigerant and the air using a fan (not shown), and functions as an evaporator during the cooling operation and as a condenser during the heating operation. The indoor expansion valve 82 is a valve whose opening degree is adjustable, and functions as a decompressor of the refrigerant.

(1-3) Refrigerant Piping 70

The refrigerant piping 70 functions as a path for moving the refrigerant between the outdoor unit 60 and the indoor unit 80. The refrigerant piping 70 includes a liquid refrigerant pipe 71 and a gas refrigerant pipe 72. The liquid refrigerant pipe 71 is a pipe for allowing the liquid shutoff valve 67 and the indoor expansion valve 82 to communicate with each other, and mainly moves the liquid refrigerant or the gas-liquid two-phase refrigerant. The gas refrigerant pipe 72 is a pipe for allowing the gas shutoff valve 68 and the indoor heat exchanger 81 to communicate with each other and mainly moves the gas refrigerant.

(2) Detailed Description of the Configuration

Figure 2:
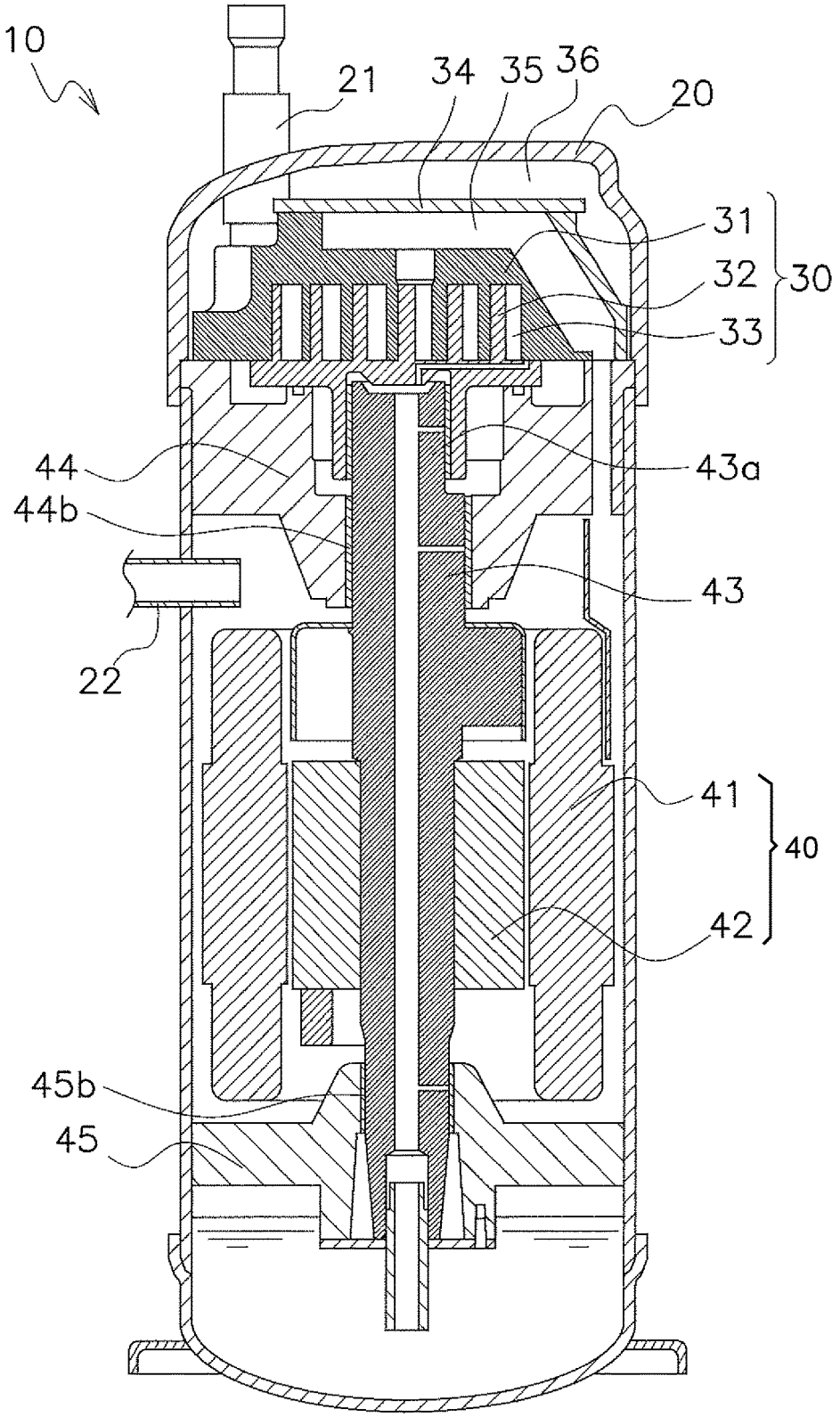
FIG. 2 is a cross-sectional view of the compressor 10 according to the first embodiment of the present invention.
Figure 3:
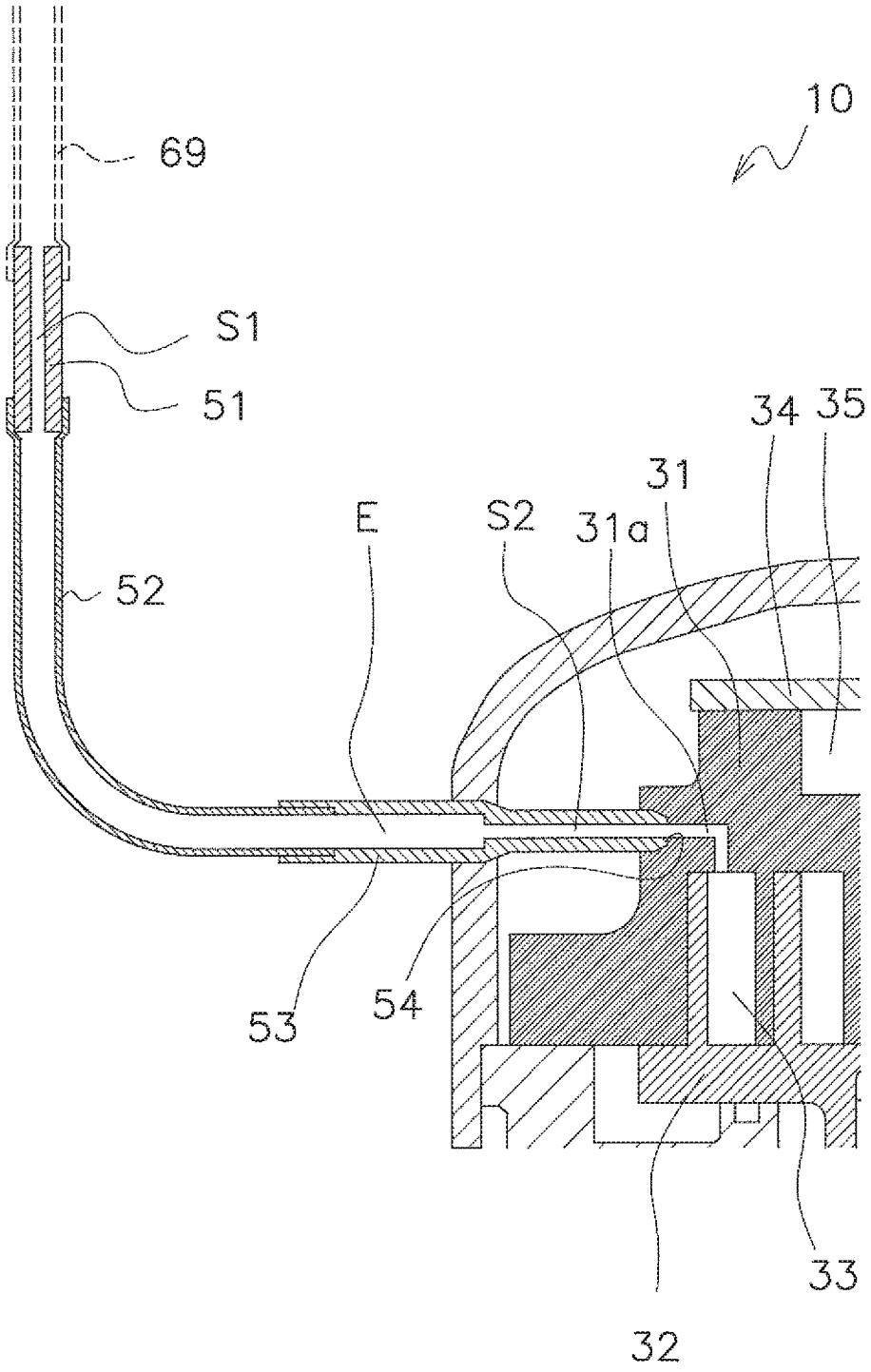
FIG. 3 is an enlarged cross-sectional view of the compressor 10.

FIG. 2 is a cross-sectional view of the compressor 10. The compressor 10 is a scroll compressor. The compressor 10 includes a pressure vessel 20, a compression element 30, a chamber forming member 34, a motor 40, a crankshaft 43, a first support member 44, and a second support member 45. Further, as shown in FIG. 3, the compressor 10 includes an injection pipe connecting portion 51, an extension pipe 52, and a compression element connecting portion 53.

(2-1) Pressure Vessel 20

Returning to FIG. 2, housing the constituent parts of the compressor 10 and the refrigerant, the pressure vessel 20 has a strength that can withstand the high pressure possessed by the refrigerant. A suction pipe 21 for sucking in low-pressure gas refrigerant and a discharge pipe 22 for discharging high-pressure gas refrigerant are attached to the pressure vessel 20.

(2-2) Compression Element 30

The compression element 30 is a mechanism for compressing the gas refrigerant. The compression element 30 includes a fixed scroll 31 and a movable scroll 32. The fixed scroll 31 is directly or indirectly fixed to the pressure vessel 20. The movable scroll 32 is revolvable with respect to the fixed scroll. A compression chamber 33 is defined by the fixed scroll 31 and the movable scroll 32. As the movable scroll 32 revolves, the volume of the compression chamber 33 changes to thereby compress the gas refrigerant. The high-pressure gas refrigerant that has undergone the compression process exits the compression element 30 and moves toward a chamber 35 to be described later.

(2-3) Chamber Forming Member 34

The chamber forming member 34 divides the inner space of the pressure vessel 20 into a chamber 35 and a space 36 outside of the chamber. The chamber 35 is filled with the high-pressure gas refrigerant and is a space that functions as a flow path for the high-pressure gas refrigerant. The space outside the chamber is a space filled with the low-pressure gas refrigerant. The motor 40, the crankshaft 43, the first support member 44, and the second support member 45 are attached to the chamber 35.

(2-4) Motor 40

The motor 40 receives electric power to generate power for the compression element 30. The motor 40 includes a stator 41 and a rotor 42. The stator 41 is directly or indirectly fixed to the pressure vessel 20. The rotor 42 can rotate by performing a magnetic interaction with the stator 41.

(2-5) Crankshaft 43

The crankshaft 43 transmits the power generated by the motor 40 to the compression element 30. The crankshaft 43 is fixed to the rotor 42 and rotates together with the rotor 42. The crankshaft 43 includes an eccentric portion 43*a* that is coupled to the movable scroll 32. As the crankshaft 43 rotates, the eccentric portion 43*a* revolves, thereby causing the movable scroll 32 to revolve.

(2-6) First Support Member 44

The first support member 44 directly or indirectly supports the fixed scroll 31. The first support member 44 is directly or indirectly fixed to the pressure vessel 20. The first support member 44 supports a first bearing 44*b*, and the first bearing 44*b* pivotally supports the crankshaft 43.

(2-7) Second Support Member 45

The second support member 45 is directly or indirectly fixed to the pressure vessel 20. The second support member 45 supports a second bearing 45*b*, and the second bearing 45*b* pivotally supports the crankshaft 43.

(2-8) Injection Pipe Connecting Portion 51, Extension Pipe 52, Compression Element Connecting Portion 53

FIG. 3 is an enlarged cross-sectional view of the compressor 10. An injection pipe 69 of the refrigerant circuit 100 is connected to the injection pipe connecting portion 51 of the compressor 10. The injection pipe connecting portion 51 is connected to the extension pipe 52. The extension pipe 52 is connected to a compression element connecting portion 53.

The injection pipe connecting portion 51 is a rigid body, and a first throttle portion S1 having a relatively small flow path cross-sectional area is formed therein. The extension pipe 52 is a metal pipe. The compression element connecting portion 53 is a rigid body, and an enlarged flow path portion E having a relatively large flow path cross-sectional area and a second throttle portion S2 having a relatively small flow path cross-sectional area are formed therein. The compression element connecting portion 53 is fixed to one or both of the pressure vessel 20 and the compression element 30. A distal end of the compression element connecting portion 53 is embedded in the fixed scroll 31. At this distal end, an end portion of the second throttle portion S2 forms an injection spray hole 54. A refrigerant path 31*a* that allows the second throttle portion and the compression chamber 33 to communicate with each other is formed in the fixed scroll 31. The injection spray hole 54 is connected to this refrigerant path 31*a*. At least a part of the second throttle portion S2 is provided in the pressure vessel 20.

(3) Details of the Injection Path

Figure 4:
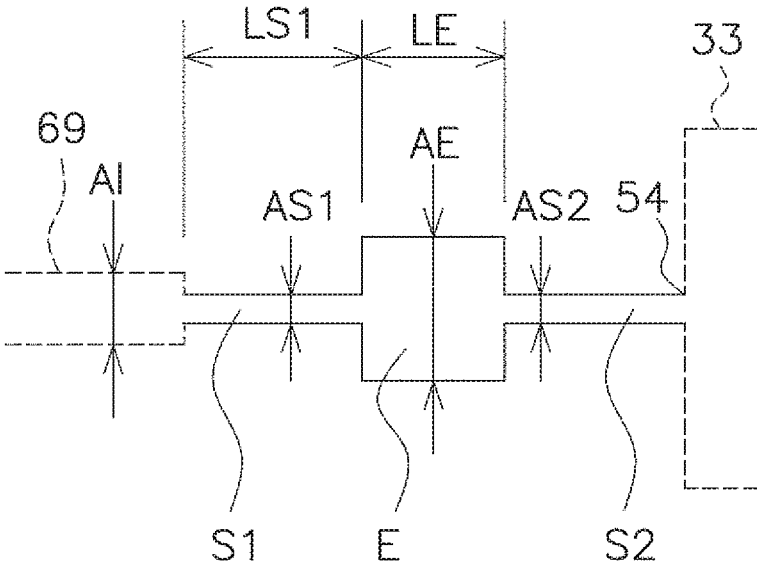
FIG. 4 is a schematic diagram of an injection path.

FIG. 4 is a schematic diagram of an injection path. The refrigerant passes through each part that constitute the injection path in the following order: the injection pipe 69; the first throttle portion S1; the enlarged flow path portion E; the second throttle portion S2: and the compression chamber 33. The flow path cross-sectional areas of the injection pipe 69, the first throttle portion S1, the enlarged flow path portion E, and the second throttle portion S2 are denoted by A1, AS1, AE, and AS2, respectively. The lengths of the first throttle portion S1 and the enlarged flow path portion E are denoted by LS1 and LE, respectively.

The flow path cross-sectional area AS1 of the first throttle portion S1 is narrower than both the flow path cross-sectional area A1 of the injection pipe 69 and the flow path cross-sectional area AE of the enlarged flow path portion E. The flow path cross-sectional area AE of the enlarged flow path portion E is larger than both the flow path cross-sectional area AS1 of the first throttle portion S1 and the flow path cross-sectional area AS2 of the second throttle portion S2. The ratio AE/AS1 of the flow path cross-sectional areas AE and AS1 of the enlarged flow path portion E and the first throttle portion S1 is preferably 1.5 or more, and more preferably 4.0 or more. The ratio AE/AS2 of the flow path cross-sectional areas AE and AS2 of the enlarged flow path portion E and the second throttle portion S2 is preferable 1.5 or more, and more preferable 4.0 or more.

The length LS1 of the first throttle portion S1 is not less than 20 mm and not more than 200 mm.

The length LE of the enlarged flow path portion E is not less than 50 mm and not more than 400 mm.

(4) Features (4-1)

The first throttle portion S1, the enlarged flow path portion E, and the second throttle portion S2 have different flow path cross-sectional areas AS1, AE, and AS2, respectively. Thus, the path composed of the first throttle portion S1, the enlarged flow path portion E, and the second throttle portion S2 functions as a muffler and reduces the vibration of each portion caused by the pressure pulsation of the refrigerant.

(4-2)

At least a part of the second throttle portion S2 is provided in the pressure vessel 20. Therefore, a part of the flow of the pulsating refrigerant passes through the compression vessel whereby the noise outside the pressure vessel is reduced.

(4-3)

A portion of the enlarged flow path portion E and the second throttle portion are the same member. Therefore, it is easy to assemble a path functioning as a muffler.

(4-4)

The ratio AE/AS1 of the flow path cross-sectional areas AE and AS1 of the enlarged flow path portion E and the first throttle portion S1 is 1.5 or more, preferably 4.0 or more. Therefore, vibrations are effectively reduced.

(4-5)

The ratio AE/AS2 of the flow path cross-sectional areas AE and AS2 of the enlarged flow path portion E and the second throttle portion S2 is 1.5 or more, preferably 4.0 or more. Therefore, vibrations are more effectively reduced.

(4-6)

The first throttle portion S1 ensures a predetermined length. Therefore, vibrations are more effectively reduced.

(4-7)

The enlarged flow path portion E ensures the predetermined length LE. Therefore, vibrations are more effectively reduced.

(4-8)

The refrigerant passes through the fixed scroll 31. Therefore, the refrigerant is stably supplied to the compression chamber 33 defined by the fixed scroll 31.

(5) Modification Examples

Hereinafter, modification examples of the present exemplary embodiment will be described.

(5-1) First Modification Example

Figure 5:
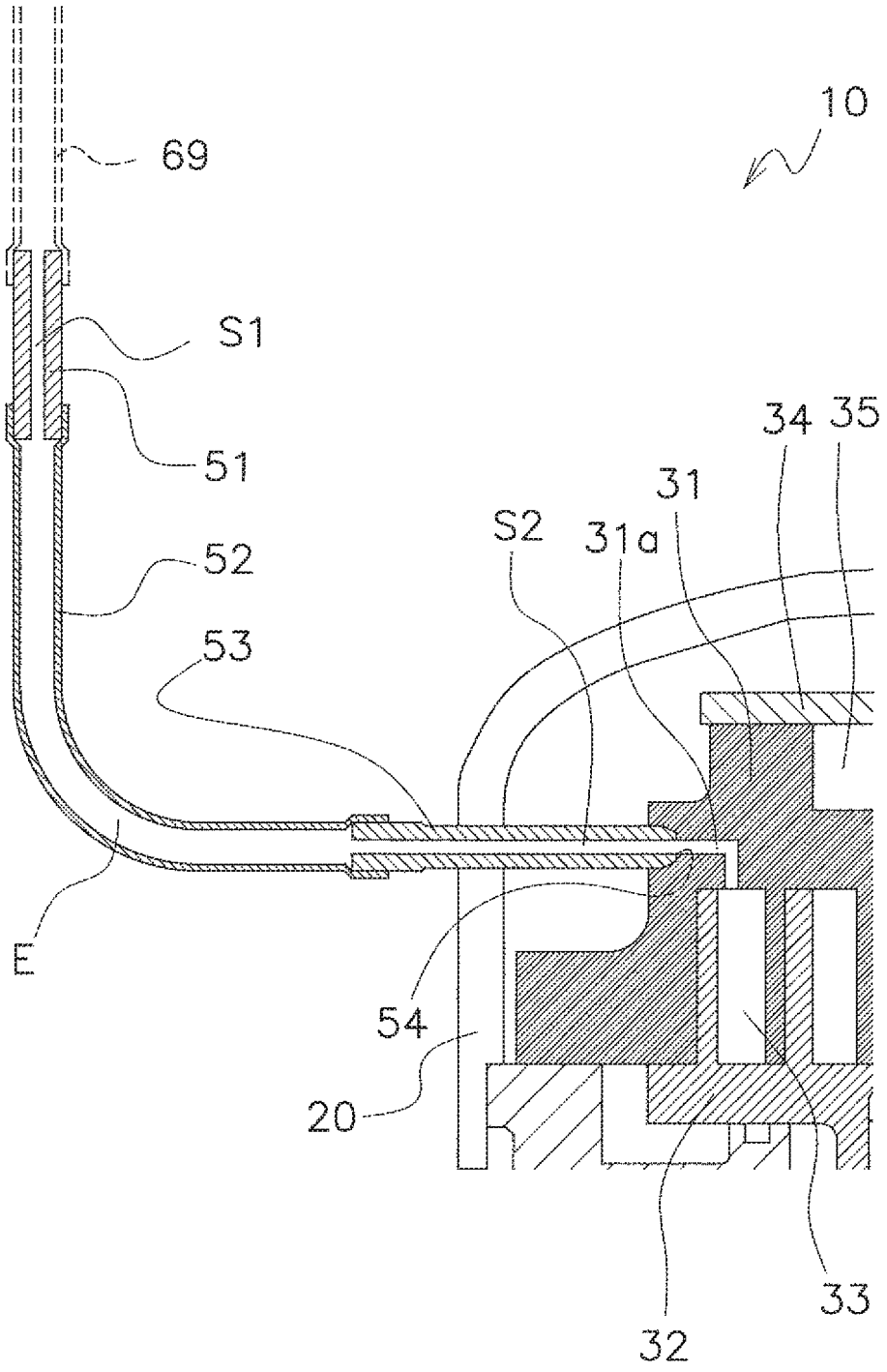
FIG. 5 is an enlarged cross-sectional view of a compressor according to a first example modification of the first embodiment of the present invention.

In the above described exemplary embodiment, a portion of the enlarged flow path portion E and the second throttle portion S2 are constituted by the same member, that is, the compression element connecting portion 53. Alternatively, as shown in FIG. 5, the first throttle portion S1, the enlarged flow path portion E, and the second throttle portion S2 may be configured as separate members.

According to this configuration, the first throttle portion, the enlarged flow path portion, and the second throttle portion are configured as separate members. Therefore, a specification of the path functioning as the muffler can be easily modified by replacing the parts thereof.

(5-2) Second Modification Example

Figure 6:
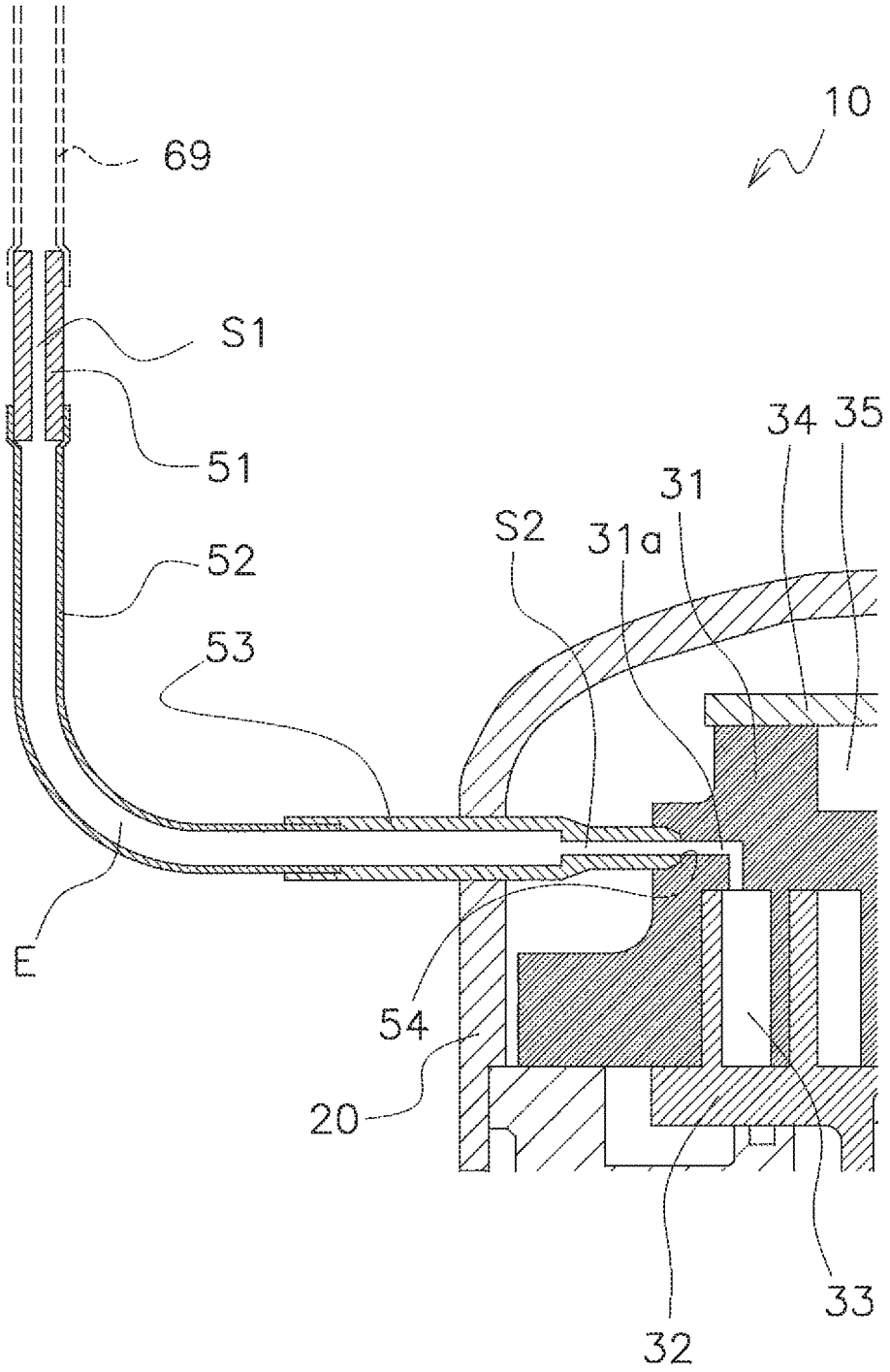
FIG. 6 is an enlarged cross-sectional view of a compressor according to a second example modification of the first embodiment of the present invention.

In the above described exemplary embodiment, the enlarged flow path portion E is provided outside the pressure vessel 20. Alternatively, as shown in FIG. 6, the enlarged flow path portion E may be at least partly provided in the pressure vessel 20.

According to this configuration, at least a part of the enlarged flow path portion E is provided in the pressure vessel 20. Therefore, a pressure fluctuation of the refrigerant flowing from the enlarged flow path portion E to the second throttle portion S2 occurs in the pressure vessel 20, whereby the noise outside the pressure vessel 20 is reduced.

(5-3) Third Modification Example

Figure 7:
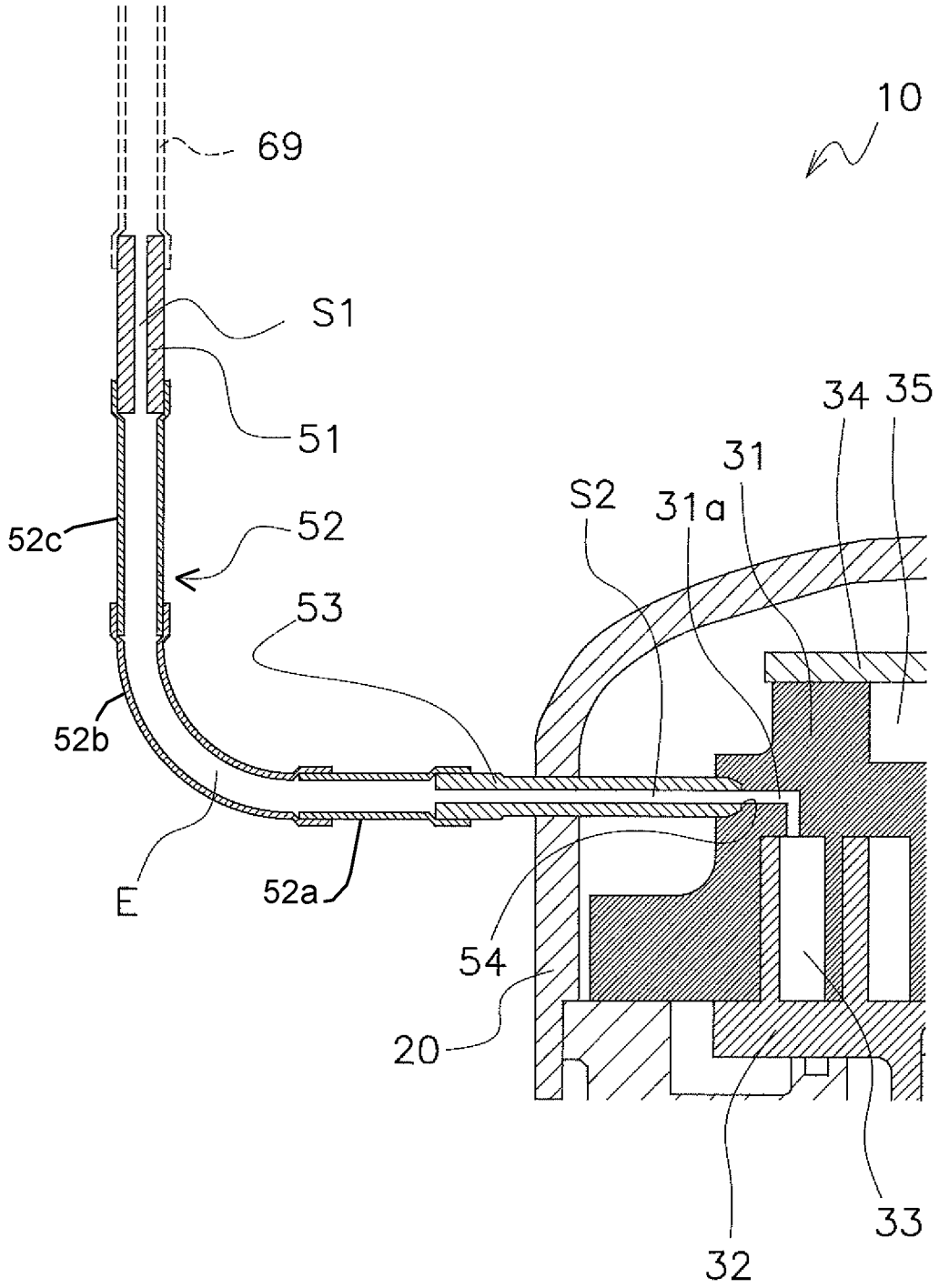
FIG. 7 is an enlarged cross-sectional view of a compressor according to a third example modification of the first embodiment of the present invention.

In the first example modification shown in FIG. 5, the enlarged flow path portion E is formed by the extension pipe 52 which is a single member. As an alternative to this, as shown in FIG. 7, a configuration may be adopted in which the enlarged flow path portion E is composed of a plurality of members 52*a*, 52*b*, and 52*c*.

According to this configuration, the enlarged flow path portion E is composed of the plurality of members 52*a*, 52*b*, and 52*c*. Therefore, it is easy to adjust a length, a flow path cross-sectional area, a radius of curvature, and the like of the enlarged flow path portion E by replacing the parts thereof.

(5-4) Fourth Modification Example

Figure 8:
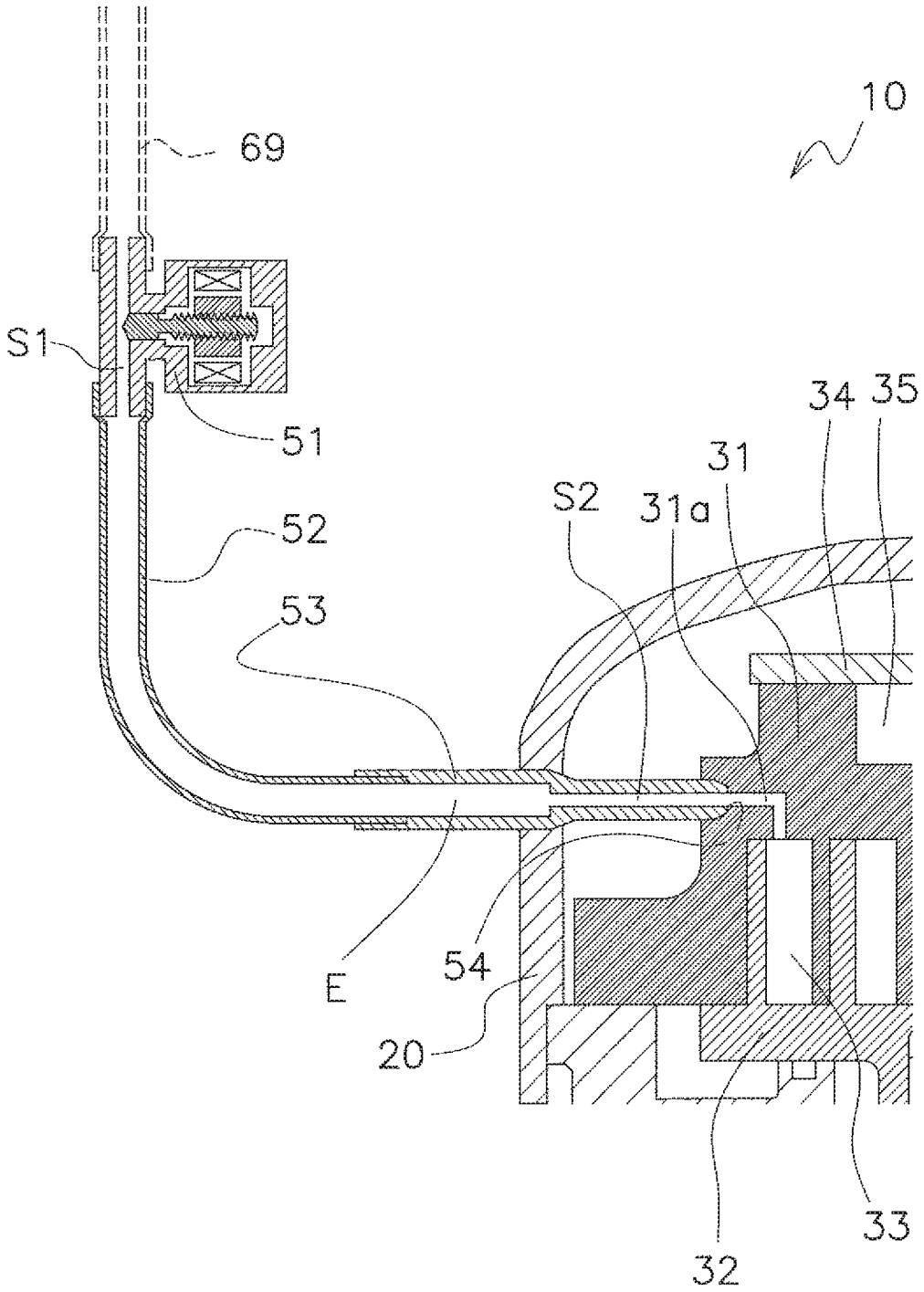
FIG. 8 is an enlarged cross-sectional view of a compressor according to a fourth example modification of the first embodiment of the present invention.

In the above exemplary embodiment, the first throttle portion S1 is merely composed of a rigid member. As an alternative to this, as shown in FIG. 8, the first throttle portion S1 may be constituted by a commercially available controllable valve. Such a valve is one that is electrically, magnetically, or pneumatically driven so that the opening/closing of the valve and the opening degree thereof are controlled.

According to this configuration, the first throttle portion S1 is a valve whose opening/closing or opening degree is controlled. Consequently, the arrangement of the controllable valve enables the first throttle portion to be easily configured.

(5-5) Fifth Modification Example

In the above exemplary embodiment, the compressor 10 is a scroll compressor. Alternatively, the compressor 10 may be a rotary compressor or other types of compressor.

(5-6) Sixth Modification Example

In the above exemplary embodiment, the vibration of the injection pipe 69 is reduced by installing the injection pipe connecting portion 51, the extension pipe 52, and the compression element connecting portion 53. As an alternative to this, reducing the vibrations of the suction pipe 21 or the discharge pipe 22 may be realized by providing similar members in the suction pipe 21 or the discharge pipe 22.

(5-7) Seventh Modification Example

A valve structure may be provided in the second throttle portion S2. The valve structure may be a check valve.

Second Exemplary Embodiment (1) Configuration

Figure 9:
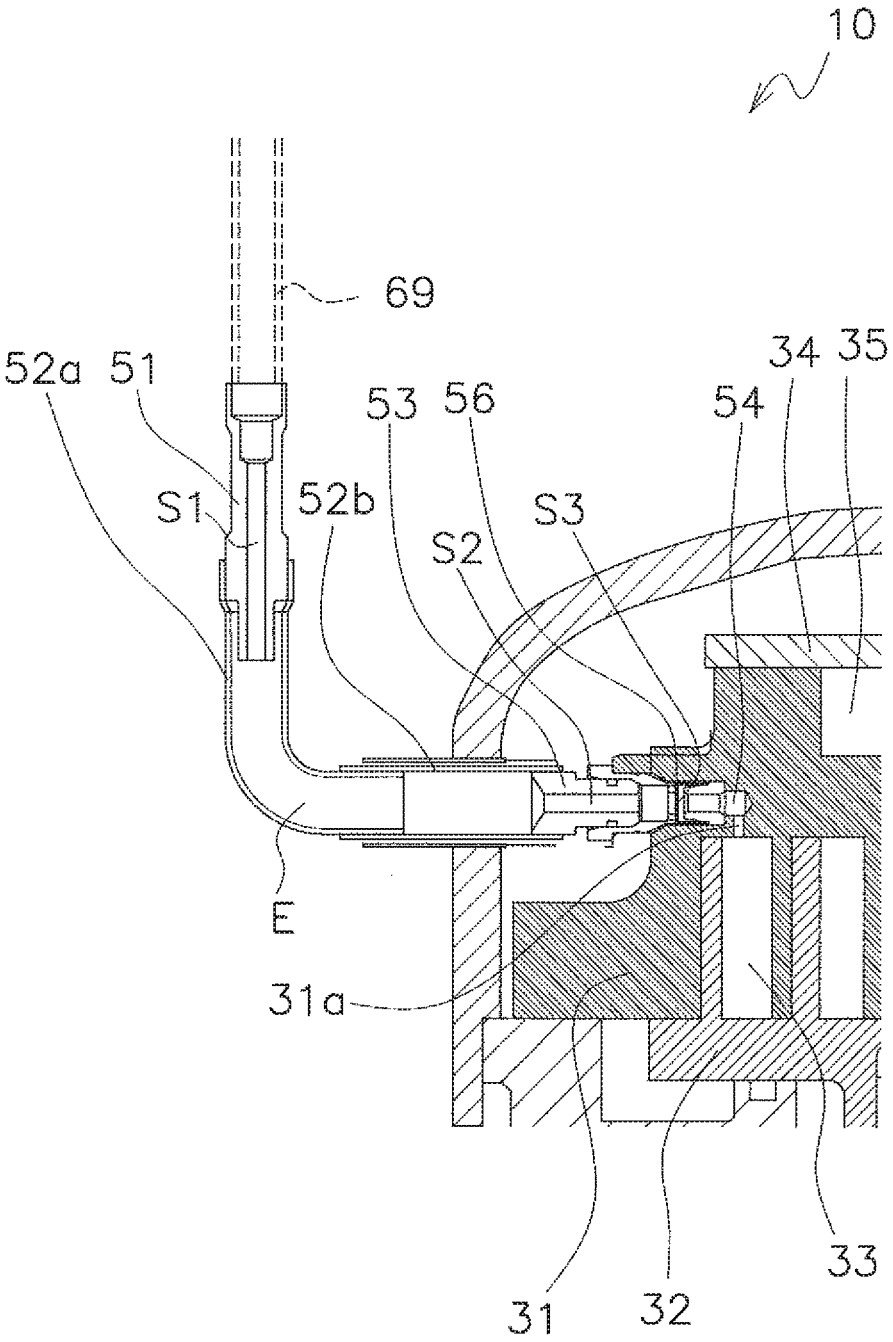
FIG. 9 is an enlarged cross-sectional view of a compressor according to a second embodiment of the present invention.

FIG. 9 is a view of a compressor 10 according to a second exemplary embodiment of the present invention. The compressor 10 according to the present exemplary embodiment differs from that of the first exemplary embodiment in that it includes not only the first throttle portion S1 and the second throttle portion S2 but also includes a third throttle portion S3. The third throttle portion S3 is connected to the second throttle portion S2. The third throttle portion S3 receives the refrigerant from the second throttle portion S2 and guides the refrigerant to the compression chamber 33. The third throttle portion S3 is constituted by a flow path 56. The flow path 56 may be formed integrally of the same member as the second throttle portion S2. Alternatively, the flow path 56 may be formed of a separate member from the second throttle portion S2.

The first throttle portion S1, the enlarged flow path portion E. and the second throttle portion S2 are formed of separate members. Furthermore, the enlarged flow path portion E is constituted by a plurality of members 52*a* and 52*b*.

Figure 10:
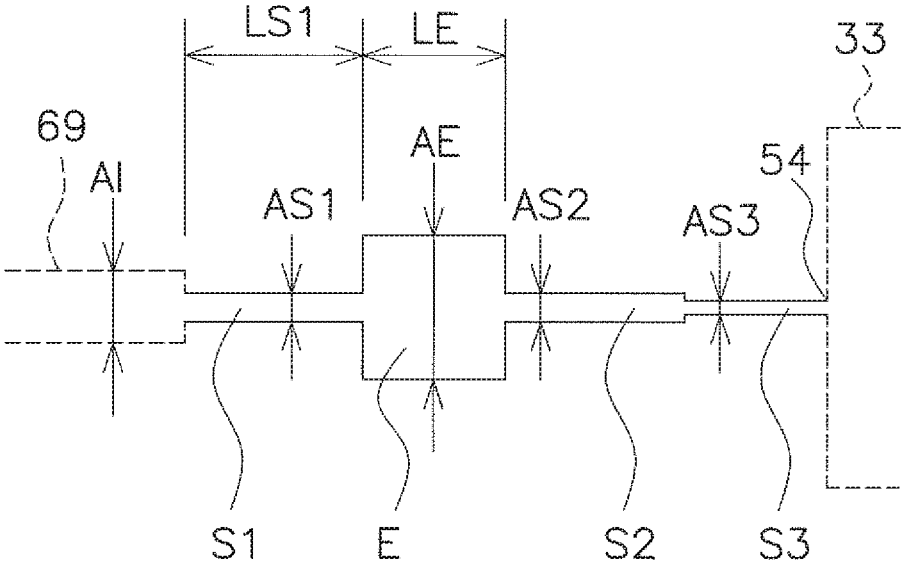
FIG. 10 is a schematic diagram of an injection path.

FIG. 10 is a schematic diagram of an injection path. The respective symbols are the same as those in FIG. 4 of the first exemplary embodiment. The third throttle portion S3 has a flow path cross-sectional area AS3 that is narrower than the flow path cross-sectional area AS2 of the second throttle portion S2.

(2) Features (2-1)

With the inclusion of the third throttle portion S3 in the injection path, the pulsation of the refrigerant can be further reduced when the refrigerant flows from the second throttle portion S2 to the third throttle portion S3.

(2-2)

The first throttle portion S1 the enlarged flow path portion E, and the second throttle portion S2 are configured as separate members. Therefore, a specification of the path functioning as the muffler can be easily modified by replacing the parts thereof.

(2-3)

The enlarged flow path portion E is constituted by the plurality of members 52*a* and 52*b*. Therefore, a length, a flow path cross-sectional area, a radius of curvature, and the like of the enlarged flow path portion E can be easily adjusted by replacing the parts thereof.

(3) Modification Examples (3-1)

A valve structure may be provided in the second throttle portion S2 or the third throttle portion S3. The valve structure may be a check valve.

(3-2)

The respective example modifications of the first exemplary embodiment may be applied independently or in combination to the present exemplary embodiment.

Third Exemplary Embodiment (1) Configuration

Figure 11:
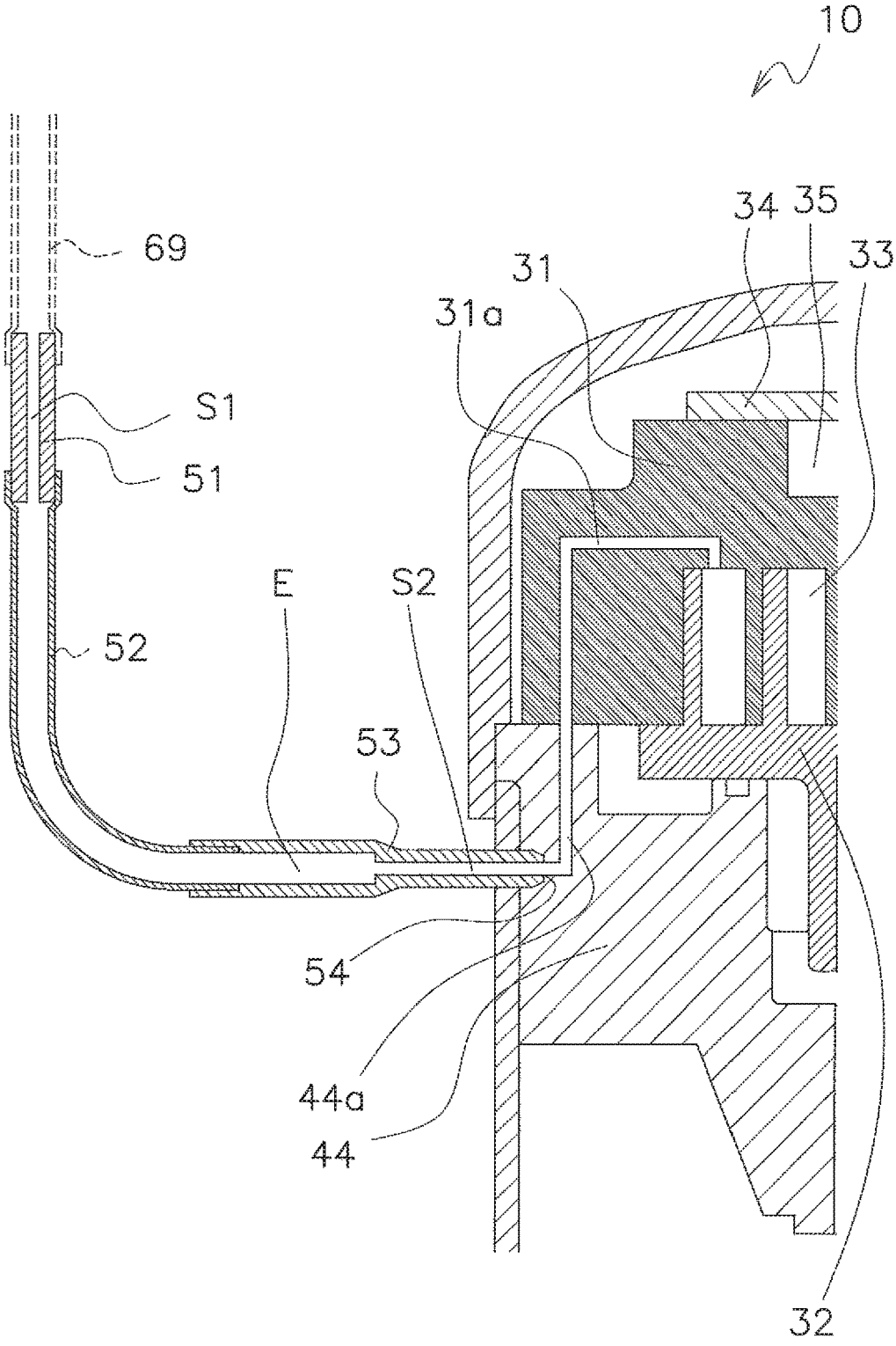
FIG. 11 is an enlarged cross-sectional view of a compressor 10 according to a third embodiment of the present invention.

FIG. 11 is a view of a compressor according to a third exemplary embodiment. The present exemplary embodiment differs from the first exemplary embodiment in that the compression element connecting portion 53 is embedded in the first support member 44. The injection spray hole 54 communicates with the compression chamber 33 through the refrigerant path 44*a* formed in the first support member 44 and then through the refrigerant path 31*a* formed in the fixed scroll 31.

(2) Features

According to this configuration, the refrigerant passes through the first support member 44. Therefore, the refrigerant is stably supplied to the compression chamber 33 defined by the fixed scroll 31 via the first support member 44.

(3) Modification Examples

The various modifications of the above exemplary embodiments may be applied independently or in combination to the present exemplary embodiment.

Fourth Exemplary Embodiment (1) Configuration

Figure 12:
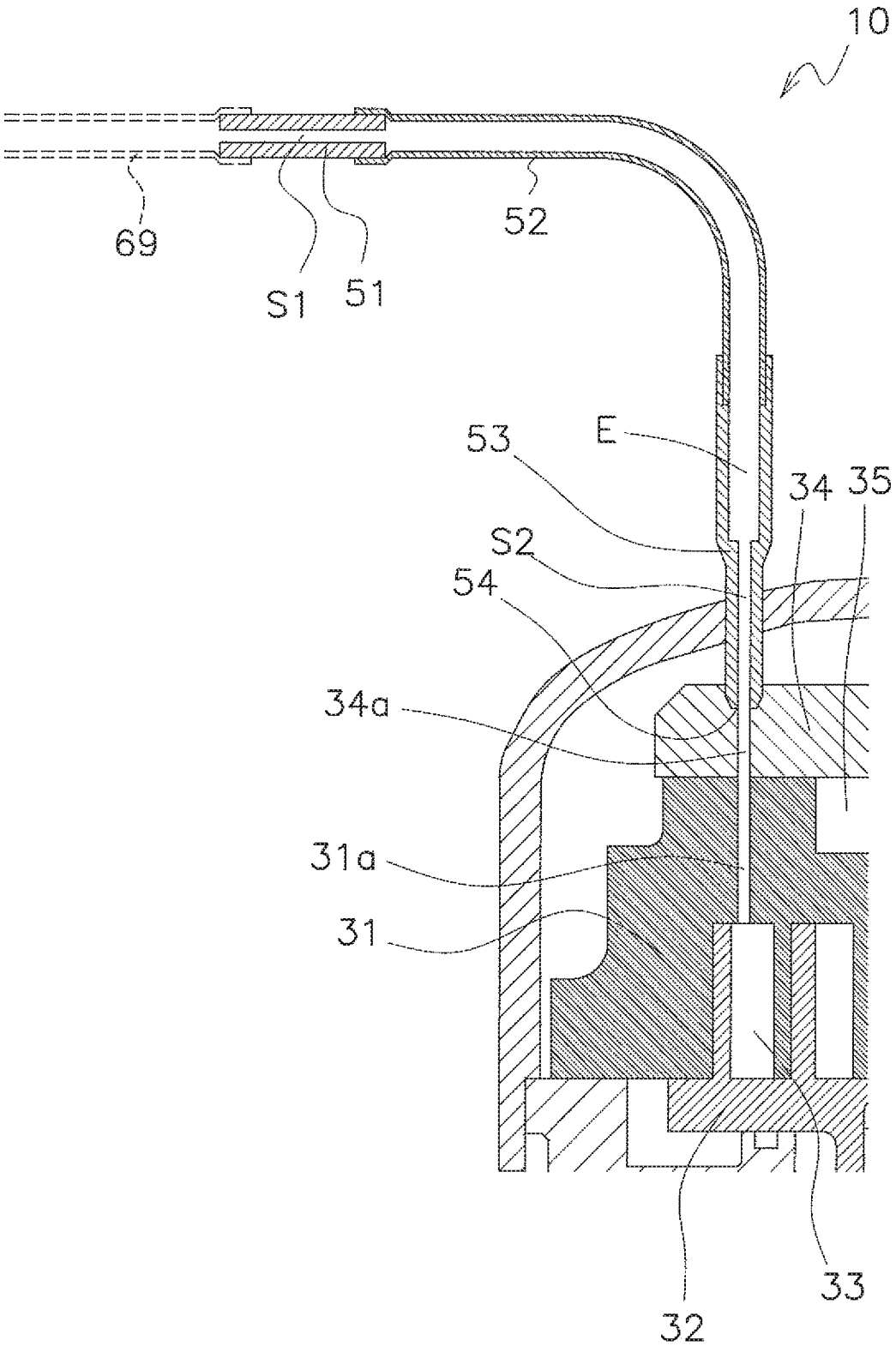
FIG. 12 is an enlarged cross-sectional view of a compressor 10 according to a fourth embodiment of the present invention.

FIG. 12 is a view of a compressor 10 according to a fourth exemplary embodiment. The present exemplary embodiment differs from the above described exemplary embodiment in that the compression element connecting portion 53 is embedded in the chamber forming member 34. The injection spray hole 54 communicates with the compression chamber 33 through the refrigerant path 34*a* formed in the chamber forming member 34 and then through the refrigerant path 31*a* formed in the fixed scroll 31.

In the present exemplary embodiment, only the second throttle portion S2 is disposed in the pressure vessel 20.

(2) Features

According to this configuration, the refrigerant passes through the chamber forming member 34. Therefore, the refrigerant is stably supplied to the compression chamber 33 defined by the fixed scroll 31 via the chamber forming member 34.

(3) Modification Examples (3-1) First Modification Example

Figure 13:
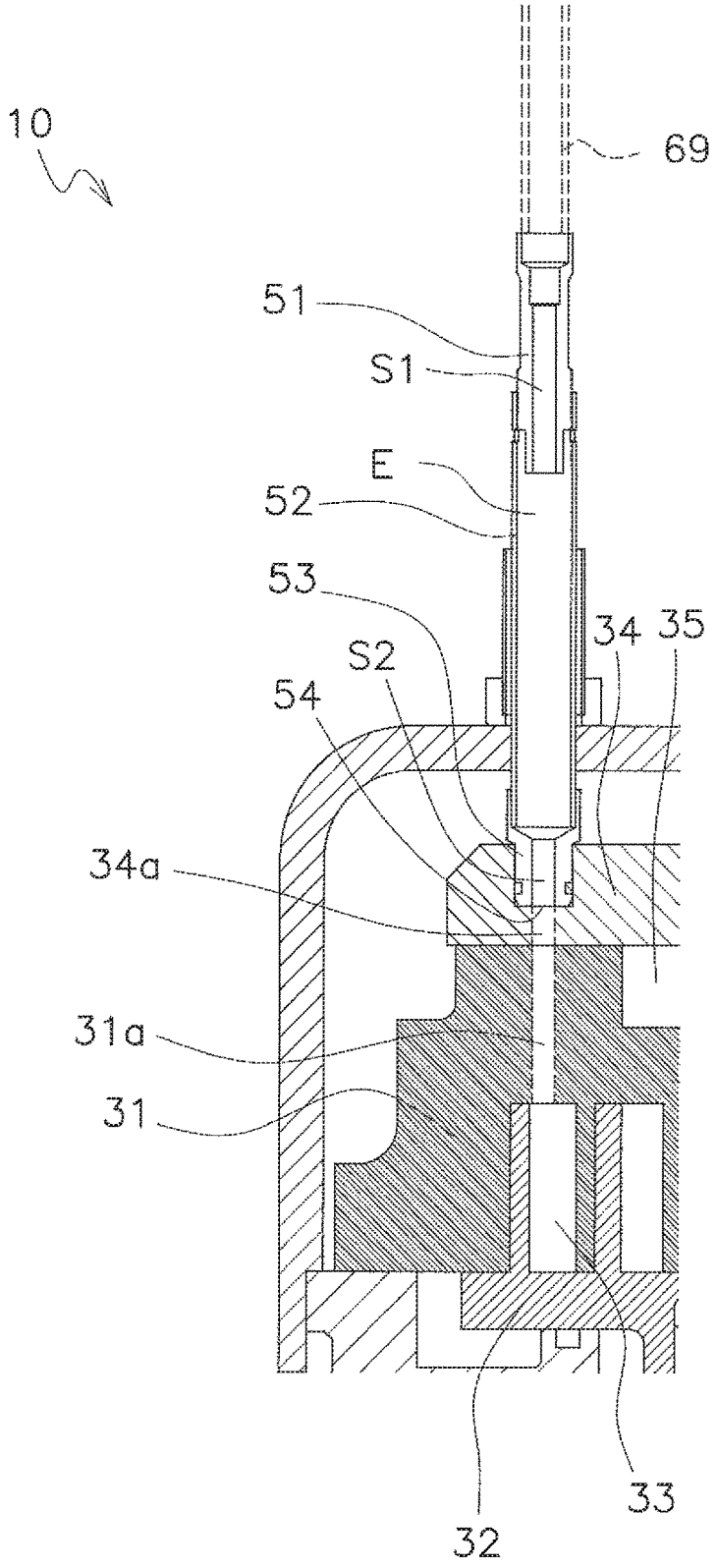
FIG. 13 is an enlarged cross-sectional view of a compressor 10 according to a first example modification of the fourth embodiment of the present invention.

As shown in FIG. 13, not only the second throttle portion S2 but also part of the enlarged flow path portion E may be disposed in the pressure vessel 20.

(3-2) Others

The various modifications of the above exemplary embodiments may be applied independently or in combination to the present exemplary embodiment.

What is claimed is:

1. A compressor that compresses a low-pressure refrigerant sucked therein to produce a high-pressure refrigerant to discharge, the compressor comprising:

a first throttle portion that receives a refrigerant at an intermediate pressure from an injection pipe of a refrigerant circuit, the first throttle portion being provided in an injection pipe connecting portion in contact with an inner surface of the injection pipe;

an enlarged flow path portion that receives the refrigerant from the first throttle portion;

a second throttle portion that receives the refrigerant from the enlarged flow path portion; and a compression element including a compression chamber that receives the refrigerant from the second throttle portion, the first throttle portion having a flow path cross-sectional area that is narrower than both a flow path cross-sectional area of the injection pipe and a flow path cross-sectional area of the enlarged flow path portion, and the second throttle portion having a flow path cross-sectional area that is narrower than the flow path cross-sectional area of the enlarged flow path portion.

2. The compressor according to claim 1 further comprising a pressure vessel that accommodates the compression element, at least a part of the second throttle portion being provided in the pressure vessel.

3. The compressor according to claim 2, wherein at least a part of the enlarged flow path portion is provided in the pressure vessel.

4. The compressor according to claim 2, wherein the enlarged flow path portion and the second throttle portion are portions of a same member.

5. The compressor according to claim 2, wherein
the first throttle portion, the enlarged flow path portion, and the second throttle portion are each configured as separate members.

6. The compressor according to claim 2, wherein
the enlarged flow path portion is formed of a plurality of members.

7. The compressor according to claim 2, wherein
the flow path cross-sectional area of the enlarged flow path portion is 1.5 times or more larger than the flow path cross-sectional area of the first throttle portion.

8. The compressor according to claim 2, wherein
the flow path cross-sectional area of the enlarged flow path portion is 1.5 times or more larger than the flow path cross-sectional area of the second throttle portion.

9. The compressor according to claim 1, wherein
the enlarged flow path portion and the second throttle portion are portions of a same member.

10. The compressor according to claim 1, wherein
the first throttle portion, the enlarged flow path portion, and the second throttle portion are each configured as separate members.

11. The compressor according to claim 1, wherein
the enlarged flow path portion is formed of a plurality of members.

12. The compressor according to claim 1, wherein
the flow path cross-sectional area of the enlarged flow path portion is 1.5 times or more larger than the flow path cross-sectional area of the first throttle portion.

13. The compressor according to claim 1, wherein
the flow path cross-sectional area of the enlarged flow path portion is 1.5 times or more larger than the flow path cross-sectional area of the second throttle portion.

14. The compressor according to claim 1, wherein
the first throttle has a length that is not less than 20 mm and not more than 200 mm.

15. The compressor according to claim 1, wherein
the enlarged flow path portion has a length that is not less than 50 mm and not more than 400 mm.

16. The compressor according to claim 1, wherein
the compression element includes a fixed scroll and a movable scroll that define the compression chamber; and
the refrigerant that has exited the second throttle portion enters the compression chamber via the fixed scroll.

17. The compressor according to claim 1, wherein
the compression element includes
a fixed scroll,
a movable scroll that define the compression chamber together with the fixed scroll, and
a support member that directly or indirectly supports the fixed scroll, and
the refrigerant that has exited the second throttle portion enters the compression chamber via the support member.

18. The compressor according to claim 1, wherein
the compression element includes
a fixed scroll,
a movable scroll that define the compression chamber together with the fixed scroll, and
a chamber forming member that, together with the fixed scroll, defines a chamber,
the chamber functions as a flow path for the high-pressure refrigerant discharged from the compression chamber, and
the refrigerant that has exited the second throttle portion enters the compression chamber via the chamber forming member.

19. The compressor according to claim 1 further comprising
a third throttle portion that
receives the refrigerant from the second throttle portion and
guides the refrigerant to the compression chamber,
the third throttle portion having a flow path cross-sectional area that is narrower than the flow path cross-sectional area of the second throttle portion.

20. The compressor according to claim 1, wherein
the first throttle portion includes a valve that is electrically, magnetically, or pneumatically driven.

* * * * *